United States Patent [19]

Warren et al.

[11] Patent Number: 4,862,974

[45] Date of Patent: Sep. 5, 1989

[54] DOWNHOLE DRILLING ASSEMBLY, APPARATUS AND METHOD UTILIZING DRILLING MOTOR AND STABILIZER

[75] Inventors: Tommy M. Warren, Coweta; Warren J. Winters; James F. Brett, both of Tulsa, all of Okla.

[73] Assignee: Amoco Corporation, Chicago, Ill.

[21] Appl. No.: 281,300

[22] Filed: Dec. 7, 1988

[51] Int. Cl.[4] ..... E21B 4/02; E21B 4/20; E21B 7/28; E21B 17/00

[52] U.S. Cl. ..... 175/61; 175/107; 175/325

[58] Field of Search ..... 175/325, 107, 61, 62, 175/406, 97, 98

[56] References Cited

U.S. PATENT DOCUMENTS

| | | | |
|---|---|---|---|
| 4,270,619 | 6/1981 | Base | 175/325 X |
| 4,373,592 | 2/1983 | Dellinger | 175/325 X |
| 4,385,669 | 5/1983 | Knutsen | 175/325 X |
| 4,456,080 | 6/1984 | Holbert | 175/61 |
| 4,485,879 | 12/1984 | Kamp et al. | 175/61 |
| 4,492,276 | 1/1985 | Kamp | 175/107 X |
| 4,523,652 | 6/1985 | Schulz | 175/61 |
| 4,577,701 | 3/1986 | Dellinger et al. | 175/61 |
| 4,618,010 | 10/1986 | Falgout, Sr. et al. | 175/325 X |
| 4,776,410 | 10/1988 | Perkin et al. | 175/325 |
| 4,793,425 | 12/1988 | White | 175/325 |

*Primary Examiner*—Stephen J. Novosad

*Attorney, Agent, or Firm*—Scott H. Brown; Fred E. Hook

[57] ABSTRACT

A downhole drilling apparatus for use with an undergauge drill bit comprises a downhole drilling motor which includes a housing and means for rotating the drill bit relative to the housing about an axis of rotation. The apparatus also comprises stabilizers connected to the housing for stabilizing the drill bit, and it further comprises cutters connected to the housing for cutting a borehole wall created by passage of the drill bit, wherein the cutters extend radially outwardly relative to the axis of rotation to a greater extent than does the drill bit. A drilling assembly including such a drilling apparatus and a method of drilling a substantially vertical borehole in an earthen formation utilizing such an apparatus are also disclosed.

20 Claims, 4 Drawing Sheets

DOWNHOLE DRILLING ASSEMBLY, APPARATUS AND METHOD UTILIZING DRILLING MOTOR AND STABILIZER

BACKGROUND OF THE INVENTION

1. Field of the Invention

This invention relates to drilling assemblies, apparatus and methods utilizing a drilling motor and stabilizer and more particularly, but not by way of limitation, to techniques for reducing "hang-up" and "whirl" during the drilling of a borehole in an earthen formation.

2. Setting of the Invention

One technique for drilling a substantially vertical borehole in an earthen formation, such as done during prospecting for oil and gas, includes rotating a drill string with surface equipment and independently rotating a drill bit with a drilling motor located near the bottom of the drill string above the drill bit. Bit advancement or penetration is obtained, at least in part, by controlling the application of weight on the bit. A stabilizer apparatus is typically used to control to some extent the direction of drilling by reducing lateral movement or "whirl" of the drill bit as it is rotated at high speeds by the downhole drilling motor (see, U.S. Pat. Nos. 4,485,879 to Kamp, et al.; 4,643,264 to Dellinger; and 4,364,626 to Derouin).

A stabilizer can be mounted on a downhole drilling motor as disclosed in the aforementioned Kamp, et al., patent. A stabilizer can have a cutting or reaming capability as disclosed in U.S. Pat. Nos. 4,618,010 to Falgbility, Sr., et al.; 4,385,669 to Knutsen; 4,456,080 to Holbert; and 4,373,592 to Dellinger, et al. A stabilizer can be wider than a drill bit or radially extendible as disclosed in U.S. Pat. No. 4,577,701 to Dellinger, et al.; Juge, "New Bit Aids Deviated Well Drilling," Drilling Contractor (1979); U.S. Pat. Nos. 4,690,229 to Raney; and 4,270,619 to Base.

There is also a disclosure about a generally cone-shaped combination reamer and stabilizer tool disclosed to be connected above a drill bit and rotated therewith to form a curved borehole. The drill bit is pictured as having a smaller diameter than the base of the combination reamer and stabilizer tool (see U.S. Pat. No. 4,523,652 to Schuh).

Although a stabilizer can be used to maintain a proper drilling direction, or at least to reduce bit "whirl," it can "hang-up" on the uneven surface of the open borehole as the borehole is being drilling. Such "hang-up" can occur to such an extent that it prevents smooth control of the application of weight-on-bit needed to obtain a desired bit advancement or rate of penetration. Such hang-up has been found to occur particularly with respect to a drilling assembly incorporating a downhole drilling motor having a stabilizer with an overall outer diameter less than or equal to the drill bit diameter. Thus, there is the need for a better technique for reducing whirl while also reducing the likelihood of "hang-up." It is contemplated that such an improved technique would produce better, more consistent control of the application of weight to the drill bit and thus better, more consistent control of the rate of penetration. Improving control of the rate of penetration can reduce drilling costs.

SUMMARY OF THE INVENTION

The present invention is contemplated to overcome the foregoing deficiencies and meet the above-described needs. For accomplishing this, the present invention provides a novel and improved downhole drilling apparatus, assembly and method.

The downhole drilling apparatus of the present invention is for use with a drilling bit and comprises: a downhole drilling motor including a housing and means for rotating the drill bit relative to the housing about an axis of rotation, stabilizing means connected to the housing of the downhole drilling motor for stabilizing the the downhole drilling motor for cutting a borehole wall created by passage of the drill bit, wherein the cutting means extends radially outwardly relative to the axis of rotation of the drill bit to a greater extent than does the drill bit.

The drilling assembly of the present invention comprises: a string of tubular members; a drilling motor, including a housing connected to the string of tubular members; and a rotor mounted within the housing so that the rotor is rotatable relative to the housing; a drill bit connected to the rotor, the drill bit including first cutting means for cutting a borehole having a first diameter; stabilizing means for stabilizing the drill bit against lateral movement within the borehole, the stabilizing means disposed on the housing so that a diameter greater than the first diameter is defined across the stabilizing means and the housing; second cutting means, connected to the housing so that the second cutting means is below the stabilizing means, for enlarging the borehole to a second diameter substantially equal to the diameter defined across the stabilizing means and the housing; means for rotating the string of tubular members, the drilling motor, the drill bit, the stabilizing means and the second cutting means at a first speed relative to the borehole; and means for actuating the drilling motor so that the rotor and the drill bit connected thereto rotate relative to the housing and rotate relative to the borehole at a second speed greater than the first speed, whereby the drill bit and the first cutting means thereof rotate faster than the second cutting means and the stabilizing means relative to the borehole.

The method of the present invention is particularly one for drilling a substantially vertical borehole in an earthen formation. This method comprises the steps of: (a) actuating a drilling motor to rotate a rotor thereof within a housing thereof so that a drill bit connected to the rotor rotates at a first speed within the earthen formation and excavates material therefrom across a first diameter, (b) applying weight to the drilling motor, and (c) simultaneously with the steps (a) and (b), reducing hang-up and bit whirl within the borehole, including rotating the housing, to which are connected stabilizing means for stabilizing the drill bit and cutting means for enlarging the borehole, and the stabilizing means and the cutting means at a second speed less than the first speed so that the cutting means excavates material from the borehole across a second diameter greater than the first diameter to reduce the drilling motor and the stabilizer means hanging up on the borehole and further so that the stabilizing means engages the enlarged borehole to reduce lateral movement of the drill bit within the borehole. In a preferred embodiment, step (c) further includes depending the stabilizing means and the cutting means from the housing so that lower ends of the stabilizing means and the cutting means are adjacent the drill bit.

This further aspect of step (c) relates to a particular feature of the present invention which itself is a novel improvement in that it provides better stabilizing control because the stabilization occurs closer to the drill bit than has been provided by heretofore conventional stabilization. This particular aspect forms part of another definition of a downhole drilling apparatus of the present invention, namely one comprising: a drilling motor, including a housing having a lower end, and a rotor rotatably mounted within the housing, the rotor having a lower end extending from the lower end of the housing for connecting to the drill bit, and stabilizing means for stabilizing the drill bit, the stabilizing means having an upper end disposed on the housing and having a lower end overhanging the lower end of the housing.

It is contemplated that the apparatus, assembly, and method of the present invention are particularly useful for drilling oil or gas wells with a reduced likelihood of hanging up in the borehole during drilling and yet without producing significant bit whirl or otherwise deviating from a desired substantially vertical drilling path.

DETAILED DESCRIPTION OF THE PREFERRED EMBODIMENTS

Figure 1:
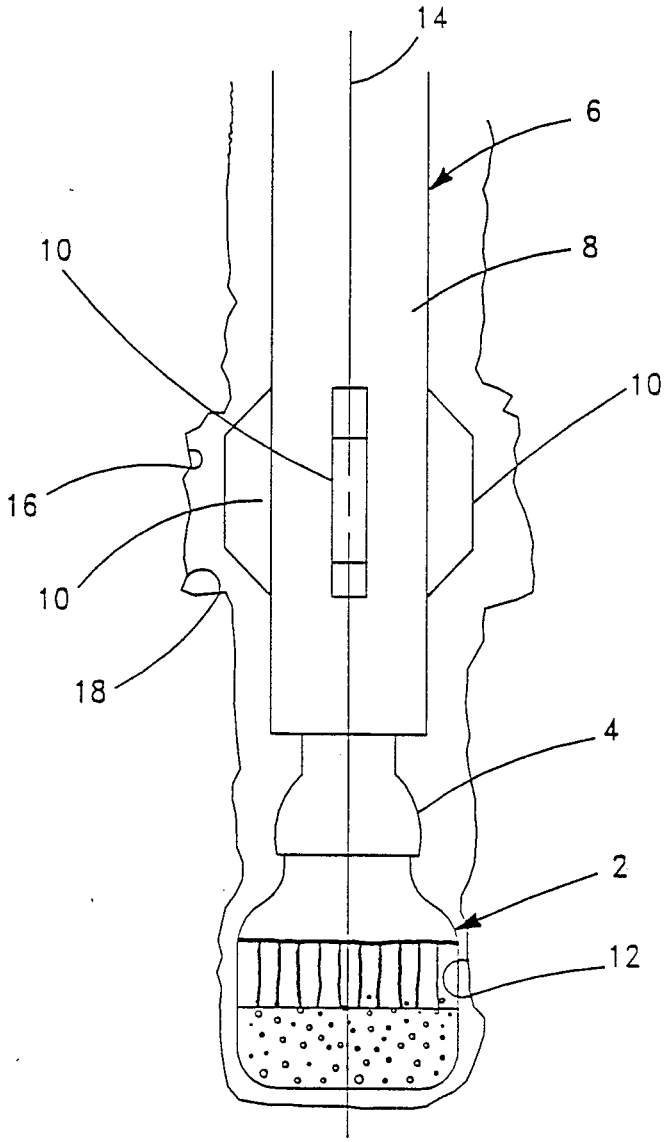
FIG. 1 is a schematic cross-sectional view of portion of a borehole in which conventional drilling equipment is disposed.

Laboratory tests have shown that at least some drill bits, when run at high speeds such as are produced by conventional downhole drilling motors, have a tendency to whirl and drill an over-gauge hole. This is detrimental to the life of the drill bit; therefore, it is important that the bit be properly stabilized to give adequate longevity to the bit. To properly stabilize the bit, however, the stabilizers need to have a diameter substantially the same as the gauge of the borehole.

In drilling a borehole with a conventional turbine drilling motor, a conventional full-gauge diamond bit, and conventional full-gauge motor-mounted stabilizers, it has been discovered that in many cases the stabilized drilling motor tends to "hang-up" in the borehole with one or more stabilizers digging into the borehole wall so that the application of weight on the bit cannot be smoothly controlled. That is, when the stabilized drilling motor hangs up, the weight of the drill string or drill collars thereof applied above the drilling motor is not properly transferred to the bit. In that the rate of penetration is dependent at least in part on the weight brought to bear on the bit and since the rate of penetration determines the efficiency and profitability of a drilling venture to an extent, the tendency of a stabilized motor to "hang-up" can have serious implications for the success of such a venture. Thus, there has been a direct conflict between running tight full-gauge stabilizers on the drilling motor to minimize bit whirl and the ability to apply weight smoothly to the full-gauge bit.

"Hang-up" of a drilling motor has been determined to occur when a measuring-while-drilling (MWD) tool directly above the motor indicates that weight is being applied to the top of the motor, but a tachometer indicates that the bit is rotating at the maximum speed, thus indicating that the bit is not loaded by the weight applied to the motor. The conclusion from these observations is that the stabilizers on the drilling motor are having to ream away rock at the borehole wall for the stabilized motor and bit to advance. Even though repeated measurements of the bit and stabilizer diameters indicate that the diameters across the full-gauge stabilizers are slightly smaller than the diameters across the full-gauge bits, the bottoms of the stabilizers are worn, thereby indicating that they are engaging and reaming the borehole.

Although it has been somewhat of a mystery as to how stabilizers could become hung up in a hole drilled by a bit having a diameter slightly larger than the diameter across the stabilizers, our laboratory tests have demonstrated a mechanism that we believe accounts for this. These laboratory tests showed that the bit whirl which occurred was intermittent and resulted in a hole that was alternately in-gauge and out-of-gauge. In one test, a caliper log showed borehole diameter oscillations of approximately 0.3 in. over a section drilled by a conventional stabilized mud motor and diamond bit. The oscillations occurred only on one side of the hole. The drill string was rotated over the interval where the oscillations occurred because the string would not slide down the hole without rotation.

It is believed that such oscillations may occur because when a stabilizer is opposite an over-gauge section of the hole, it may allow the bit to drill slightly off center so that when the drill bit advances, the stabilizer must ream in order to follow the bit. This is illustrated schematically in FIG. 1 wherein a conventional full-gauge drill bit 2 is shown connected to a rotor 4 of a conventional downhole drilling motor 6. The downhole drilling motor 6 also includes a housing 8 on which a plurality of conventional straight stabilizer blades 10 are mounted. The drill bit 2 has an outer diameter equal to the nominal gauge to which a borehole 12 is to be drilled. In forming the borehole 12, the drill bit 2, even though stabilized, could somehow whirl or otherwise deviate laterally from an axis of rotation 14 so that indentations or off sets 16 could be formed. This would create ledges 18 upon which the stabilizer blades 10 could become hung as illustrated in FIG. 1 along the left-hand side of the borehole 12. To further advance, the stabilizers 10 would have to ream the engaged portion of the borehole 12. The reaming by the stabilizers on one side of the hole could cause side forces on the bit which could cause the bit whirl and side cutting to increase. It could also cause one side of the borehole to be smooth.

The foregoing may not explain exactly how the process is initiated or occurs because if the stabilizers are doing their job ideally, the bit whirl should never begin. Possibly the process is started when a stabilizer is opposite a section that hydraulically erodes. Once the process of whirling and hanging-up starts, however, there has heretofore been, to our knowledge, no mechanism to stop it. The present invention is intended to prevent or reduce both bit whirl and hang-up.

Figure 2:
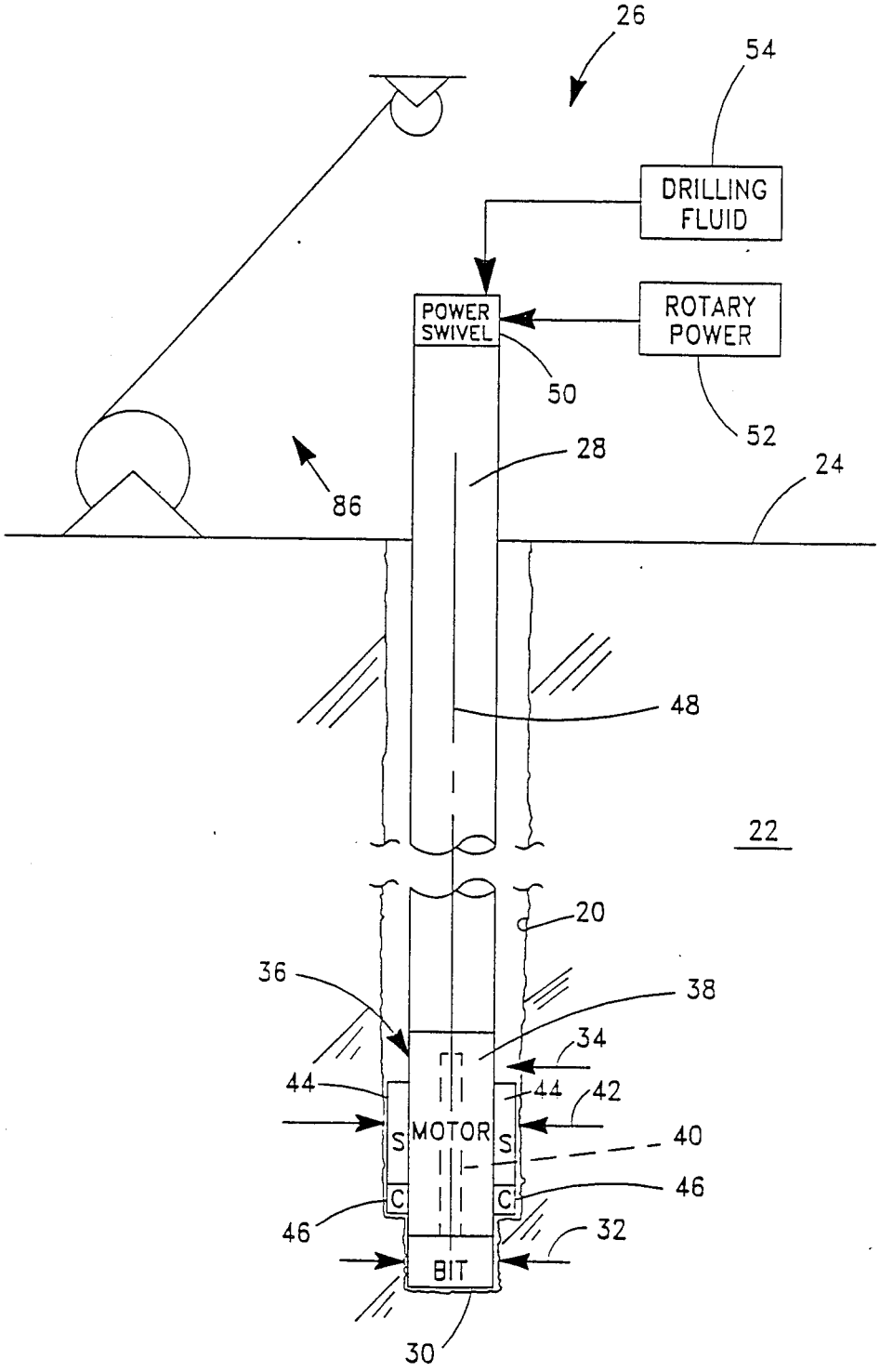
FIG. 2 is a schematic and block diagram of a drilling assembly of the present invention.

Referring now to FIGS. 2–5, the preferred embodiments of the present invention will be described. As illustrated in FIG. 2, this description will be made in the context of drilling a well bore 20 through one or more subterranean earthen formations 22 extending below surface 24.

As schematically depicted in FIG. 2, the present invention provides a drilling assembly 26. The drilling assembly 26 comprises a string of conventional tubular members 28 connected in end-to-end fashion as known to the art.

The assembly 26 also comprises a drill bit 30 which is conventional except that it is undersized so that it has an outer diameter 32 which is less than the full gauge to which the borehole 20 is ultimately to be cut. The drill bit 30 includes suitable conventional cutting means for cutting the borehole 20 to an initial diameter nominally the same as the diameter 32. The drill bit 30 is connected to the string of tubular members 28 by a downhole drilling apparatus 34 for rotating, stabilizing and continuously communicating a weight, applied by the drill string 28, to the drill bit 30.

The drilling apparatus 34, which is another part of the drilling assembly 26, includes a conventional downhole drilling motor 36, such as one of either the turbine or positive displacement type. The motor 36 includes an exterior body or housing 38 including conventional means for connecting to the drill string 28. The motor 34 also includes an internal body or rotor 40 conventionally mounted for rotating within the housing 38. The rotor 40 includes known means for connecting to the drill bit 30.

The drilling apparatus 34 also includes stabilizing means (labeled "S" in FIG. 2) for stabilizing the drill bit 30 against lateral movement (i.e., "whirl") within the borehole 20. The stabilizing means is disposed on the housing 38 of the downhole drilling motor 36 so that a diameter 42 greater than the diameter 32 of the drill bit is defined across the stabilizing means and the housing 38. The stabilizing means is illustrated in FIG. 2 as a plurality of stabilizer blades 44 connected to the housing 38 in a conventional manner (e.g., by being integrally formed on the housing 38 or welded thereto). Although the set of stabilizers 44 is an important aspect of the present invention as will become more apparent hereinbelow, other sets of stabilizers can be used at longitudinally spaced locations along the string of tubular members 28 in a conventional manner.

The downhole drilling apparatus 34 still further includes cutting means 46, connected to the housing 38 so that the cutting means is below the stabilizing means, for enlarging the borehole 20 to a diameter substantially equal to the diameter 42 defined across the stabilizing means and the housing 38. The cutting means 46 is fixed or stationary relative to the housing 38 of the drilling motor 36, and when the housing 38 is rotated by rotation of the drill string 28, the cutting means 46 rotates and it cuts the borehole wall initially established by passage of the undergauge drill bit 30. The cutting means 46 precedes the stabilizer blades 44 and extends radially from a common axis 48, along which the tubular members of the drill string 28, the drill bit 30 and the apparatus 34 are coaxially connected, to a greater extent than does the outer surface of the drill bit 30. As illustrated in FIG. 2, the cutting means 46 includes portions "C" disposed on the lower ends of the stabilizer blades 44, such as are defined by cutting edges thereof or cutting elements mounted thereon. Other particular embodiments of the cutting means will be described hereinbelow with reference to FIGS. 3 and 4. Whatever the particular embodiment, the cutting means cuts through the portion of the borehole wall that would otherwise hang-up the stabilizing means and motor and thereby prevent smooth, continuous downward movement of the connected downhole drilling components.

It is important to note that an essential feature of the present invention is that both the stabilizer means and the cutting means are connected to the housing 38 of the drilling motor 36. This prevents coupling to the stabilizing means and the cutting means the bit deviation which can result from the high-speed rotation of the drill bit 30 achieved with the drilling motor 36. Stated differently, by mounting the stabilizing means and the cutting means on the more slowly rotated housing 38 of the drilling motor 36, better stabilization can be obtained for counter-acting the tendency of the drill bit 30 to deviate under the high speeds at which it is rotated on the rotor 40 of the drilling motor 36.

The relatively low speed rotation of the housing 38 of the drilling motor 36 is obtained in the preferred embodiment illustrated in FIG. 2 by conventional means for rotating the string of tubular members 28, the drilling motor 36, the drill bit 30, the stabilizing means 44 and the cutting means 46 at a selected speed (e.g., 50–150 revolutions per minute) relative to the borehole 20. As illustrated in FIG. 2, this rotating means can be implemented by a conventional power swivel 50 driven by a suitable source of rotary power 52, such as a motor.

Although the drill bit 30 is rotatable by the aforementioned rotating means, it is rotatable at a higher speed (e.g., several hundred revolutions per minute) by operation of the drilling motor 36. Operation of the motor 36 is obtained by means for actuating the drilling motor 36 so that the rotor 40 and the drill bit 30 connected thereto rotate relative to the housing 38 and rotate relative to the borehole 20 at a speed greater than that provided by the aforementioned drill string rotating means. Thus, this causes the drill bit 30 and the cutting means thereof to rotate faster than the cutting means 46 and the stabilizing means 44 relative to the borehole 20. This drilling motor actuating means is implemented in the preferred embodiment by conventional means, such as a source 54 of pressurized drilling fluid which includes a reservoir of the fluid and a conventional pump. The fluid is pumped down the drill string in a conventional manner so that it flows through the drilling motor 36 and the drill bit 30 in a conventional manner. The flow of fluid through the motor 36 drives the rotor 40 relative to the housing 38 in a manner as known to the art.

Figure 3:
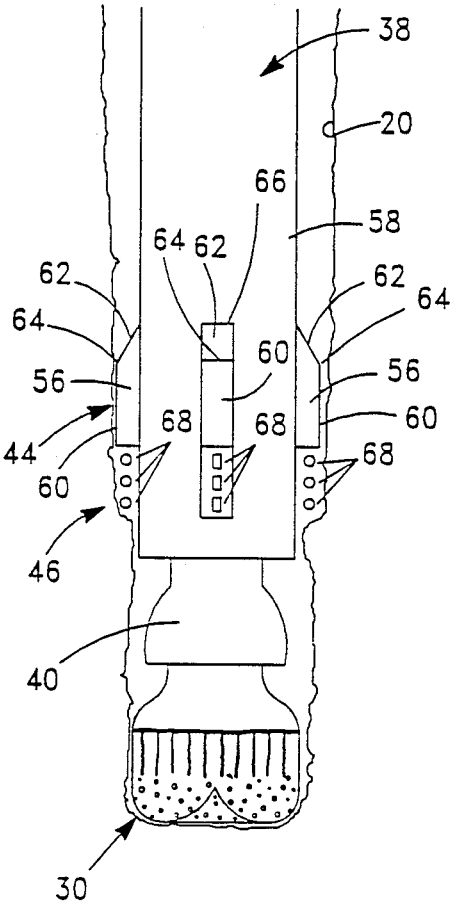
FIG. 3 is a schematic diagram of a preferred embodiment of a drilling apparatus of the present invention.
Figure 4:
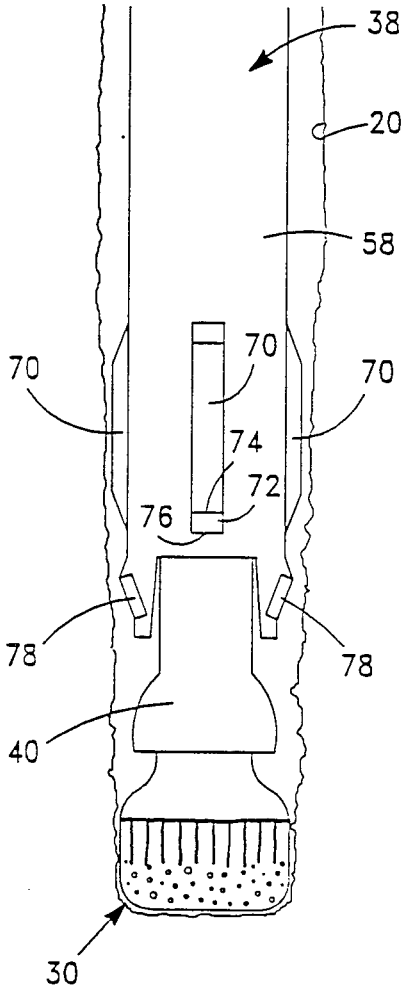
FIG. 4 is a schematic diagram of another preferred embodiment of a drilling apparatus of the present invention.
Figure 5:
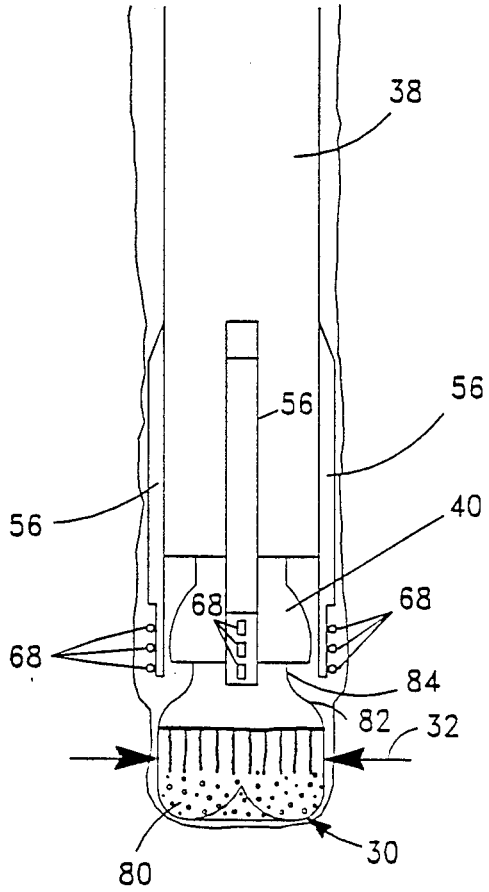
FIG. 5 is a schematic diagram of still another preferred embodiment of a drilling apparatus of the present invention.

With reference to FIGS. 3–5, other embodiments of the drilling apparatus 34 will be described. These embodiments have several elements in common with the embodiment depicted in FIG. 2 as indicated by the use of like reference numerals. The distinctions to be further described relate to the particular stabilizing means and cutting means.

In the FIG. 3 embodiment, the stabilizing means 44 comprises four (three shown, the fourth would be opposite the middle one in FIG. 3) vertically disposed straight stabilizer members 56 spaced evenly around the circumference of an outer surface 58 of the housing 38 of the drilling motor 36. The members 56 are connected to the surface 58 by suitable means, such as by being integrally formed therewith or by welding. Each stabilizer member 56 includes a rectangular surface 60 spaced radially from the surface 58 and disposed substantially parallel thereto. A rectangular surface 62 slopes from an upper edge 64, shared with the surface 60, to intersect the surface 58 at an edge 66. Although vertical stabilizer members 56 are illustrated in the drawings, spiral or slanted stabilizer members or ones of other designs may be used. A spiral stabilizer is preferred over a straight stabilizer.

At the lower ends of the stabilizer members 56 there are disposed respective drag cutter elements 68 as the cutting means 46 of the FIG. 3 embodiment. Each series or set of cutters 68 is vertically and circumferentially disposed in alignment with a respective stabilizer member 56.

The embodiment shown in FIG. 4 includes stabilizer members 70 constructed similarly to the stabilizer members 56 except that the members 70 include lower rectangular face portions 72 sloping from upper edges 74 to lower edges 76 on the surface 58 of the housing 38 of the drilling motor 36. Spaced below the surfaces 72 is the cutting means 46 of the FIG. 4 embodiment. This cutting means 46 includes roller cutters 78 which are collectively evenly distributed around the circumference of the outer surface 58 of the housing 38 of the drilling motor 36.

In the embodiment depicted in FIG. 5, as well as in the previously described embodiments, the drill bit 30 includes a main body 80 whose outer diameter 32 is defined by what is referred to as a "gauge section" or "gauge" of the bit. The upper extremity of the gauge section terminates in a shoulder 82. Extending upwardly from the shoulder 82 is a shank 84 of the drill bit 30. The shank 84 i connected to a lower end of the rotor 40 which extends below the lower end of the housing 38 of the drilling motor 36.

The stabilizing means of the embodiment shown in FIG. 5 has a design similar to that shown in FIG. 3, as indicated by the use of like reference numerals; however, for the FIG. 5 embodiment, the stabilizing members 56 are connected at upper ends to the housing 38, but the lower ends thereof, and the cutting members 68 mounted thereon, depend below the lower end of the housing 38. These lower ends of the members 56 and the cutting members 68 overhang the lower end of the housing 38 so that the lowermost edges of the members 56, 68 are at a location or locus adjacent the shoulder 82 of the drill bit 30. This places the shank 84 and the exposed lower end of the rotor 40 concentric within the overhanging lower end portions. It is contemplated that this design will be combined with a drill bit 30 having a reduced heiqht from a conventional drill bit. The advantages of this design include that the reduced height of the drill bit will decrease the surface area subject to frictional engagement between the drill bit 30 and the borehole 20 and that the lowering of the stabilizer members and cutting members will lower the fulcrum joint about which the drill bit 30 would try to pivot or whirl. Both reducing the friction and lowering the fulcrum point tend to make the bit wobble or whirl less because more friction and greater distance between the drill bit and the lowermost fulcrum point provided by a stabilizer increase bit wobble or whirl.

It is contemplated that other arrangements of stabilizing means and cutting means may be equally suitable for obtaining the advantages provided by the present invention. Likewise, modifications in the other components described herein are possible and yet remain within the scope of the present invention.

Referring again to FIG. 2, the method and operation of the present invention will be described. This method preferably pertains to drilling a substantially vertical borehole in an earthen formation. This method comprises actuating the drilling motor 36 to rotate the rotor 40 within the housing 38 so that the drill bit 30 connected to the rotor 40 rotates at a speed within the earthen formation and excavates material therefrom across the nominal diameter 32. The method also comprises applying weight to the drilling motor 36. In the embodiment illustrated in FIG. 2, this weight application is achieved by lowering the drill string 28 with a conventional winching apparatus 86 to apply weight from drill collars forming part of the string of tubular members 28. The method further comprises, simultaneously with the steps of actuating the drilling motor and applying weight to the drilling motor, the step of reducing hang-up and bit whirl within the borehole 20. This step includes rotating the housing 38 of the drilling motor 36 at a speed less than the speed at which the drill bit 30 is rotated on the rotor 43 so that the cutting means 46 excavates material from the borehole across the nominal diameter 42 and further so that the stabilizing means 44 engages the enlarged borehole to reduce lateral movement of the drill bit 30 within the borehole 23. This step further includes, for the preferred embodiment shown in FIG. 5, depending the stabilizing means and the cutting means from the housing 38 so that the lower ends of the stabilizing means and the cutting means are adjacent the drill bit 30.

By way of a specific example, assume that the diameter 32 of the drill bit 30 is nominally eight inches, and the nominal diameter across the motor 36 and the stabilizers 44 is $8\frac{1}{2}$ in. As the downhole subassembly is lowered as drilling progresses, the bit 30 cuts a smaller hole than the final hole size. Specifically, it cuts a nominally 8 in. diameter borehole. Following the drill bit 30 is the cutting means 46 which provides its cutting across the diameter 42. Thus, the cutting means 46 extends on a radius which is one-fourth inch longer than the radius of the drill bit 30. As the power swivel 50 rotates the drill string 28, this wider cutting measures 46 cuts another nominally one-quarter inch from the bore hole 20 to bring it up to gauge at nominally $8\frac{1}{2}$ in. The cutting means 46, which can also be referred to as gauge trimmers, assure that the motor-mounted stabilizers 44 are in full contact with the borehole wall at all times. Because the motor housing 38 is being rotated at a relatively slow speed (e.g., 60 revolutions per minute) compared to how fast the drill bit 30 is being rotated relative to the borehole 20, the housing 38 and the stabilizing means and cutting means connected thereto are not nearly as susceptible to the whirl phenomenon likely to be exhibited by the drill bit 30. Through this decoupling of the drill bit 30 and the stabilizing means mounted on the housing 38, the motor 36 is better maintained in the center of the borehole 20 so that the drill bit 30 will likely not as easily drill overgauge.

The present invention as claimed is directed to what is believed to be a more positive solution to the combined "whirl" and "hang-up" problem. From the foregoing, this broadly includes drilling an under-gauge hole and then obtaining full gauge from gauge cutters mounted below a stabilizer attached to a downhole motor. The cutters are intended to cut the borehole wall to prevent hang-up such as might occur when the stabilizer falls into a washout caused by erosion. This, however, should not exert a side force on the drill bit so that it prevents or provides the potential for reducing drilling costs by providing better control of the application of weight on the bit.

While presently preferred embodiments of the invention have been described herein for the purpose of disclosure, numerous changes in the construction and arrangement of parts and the performance of steps will suggest themselves to those skilled in the art, which changes are encompassed within the spirit of this invention as defined by the appended claims.

What Is claimed is:

1. A downhole drilling apparatus for use with a drill bit, comprising:

a downhole drilling motor including a housing and means for rotating the drill bit relative to said housing about an axis of rotation;

stabilizing means connected to said housing of said downhole drilling motor for stabilizing the drill bit; and cutting means connected to said housing of said downhole drilling motor for cutting a borehole wall created by passage of the drill bit, wherein said cutting means extends radially outwardly relative to the axis of rotation of said drill bit to a greater extent than does said drill bit.

2. The downhole drilling apparatus of claim 1, wherein said stabilizing means comprises a plurality of stabilizer blades connected to said housing.

3. The downhole drilling apparatus of claim 2, wherein said cutting means comprises a lower portion of each of said stabilizer blades.

4. The downhole drilling apparatus of claim 1, wherein said cutting means is evenly distributed around said housing of said downhole drilling member.

5. The downhole drilling apparatus of claim 1, wherein said cutting means comprises a roller cutter connected to said housing below said stabilizing means.

6. The downhole drilling apparatus of claim 1, wherein said cutting means comprises a drag cutter connected to said housing below said stabilizing means.

7. The downhole drilling apparatus of claim 1, wherein said stabilizing means and said cutting means depend from said housing.

8. A downhole drilling apparatus for rotating, stabilizing and continuously communicating a weight, applied by a drill string, to a drill bit having a radially outward outer surface defining a first diameter, said apparatus comprising:

a downhole drilling motor, including:

a housing including means for connecting to the drill string; and a rotor mounted for rotating within said housing, said rotor including means for connecting to the drill bit; and a plurality of stabilizers connected to said housing of said downhole drilling motor, said stabilizers having cutting portions disposed more radially outwardly than the outer surface of the drill bit when the drill bit is connected to said rotor so that, in response to simultaneous operation of said drilling motor and rotation of the drill string, said cutting portions enlarge to a second diameter a borehole initially cut by the drill bit to have a diameter approximately equal to the first diameter.

9. The downhole drilling apparatus of claim 8, wherein said cutting portions are at lower ends of said stabilizers and said lower ends of said stabilizers are disposed below said housing.

10. A drilling assembly, comprising:

a string of tubular members;

a drilling motor, including:

a housing connected to said string of tubular members; and a rotor mounted within said housing so that said rotor is rotatable relative to said housing;

a drill bit connected to said rotor, said drill bit including first cutting means for cutting a borehole having a first diameter;

stabilizing means for stabilizing said drill bit against lateral movement within the borehole, said stabilizing means disposed on said housing so that a diameter greater than said first diameter is defined across said stabilizing means and said housing;

second cutting means, connected to said housing so that said second cutting means is below said stabilizing means, for enlarging the borehole to a second diameter substantially equal to said diameter defined across said stabilizing means and said housing;

means for rotating said string of tubular members, said drilling motor, said drill bit, said stabilizing means and said second cutting means at a first speed relative to the borehole; and means for actuating said drilling motor so that said rotor and said drill bit connected thereto rotate relative to said housing and rotate relative to the borehole at a second speed greater than said first speed, whereby said drill bit and said first cutting means thereof rotate faster than said second cutting means and said stabilizing means relative to the borehole.

11. The drilling assembly of claim 10, wherein: said drill bit includes:

a main body having a gauge section; and a shank extending above said main body, said shank connected to said rotor; and said stabilizing means includes a lower end portion extending below said housing so that said shank is concentric within said lower end portion of said stabilizing means and so that the bottom of said lower end portion of said stabilizing means is adjacent the upper end of said gauge section of said main body of said drill bit.

12. The drilling assembly of claim 10, wherein:

said stabilizing means includes a plurality of stabilizer blades connected to said housing of said drilling motor; and said second cutting means includes cutting edges defined at the lower ends of said stabilizer blades.

13. The drilling assembly of claim 10, wherein said second cutting mean includes a plurality of drag cutter members connected to said housing.

14. The drilling assembly of claim 10, wherein said second cutting means includes a plurality of roller cutter members connected to said housing.

15. A downhole drilling apparatus for use with a drill bit in forming a borehole, comprising:

a drilling motor, including:

a housing having a lower end; and a rotor rotatably mounted within said housing, said rotor having a lower end extending from said lower end of said housing for connecting to the drill bit; and stabilizing means for stabilizing the drill bit, said stabilizing means having an upper end disposed on said housing and having a lower end overhanging said lower end of said housing.

16. The downhole drilling apparatus of claim 15, further comprising cutting elements disposed on said lower end of said stabilizing means.

17. The downhole drilling apparatus of claim 15, wherein said stabilizing means defines an outer diameter greater than an outer diameter of the drill bit.

18. The downhole drilling apparatus of claim 15, wherein said lower end of said stabilizing means extends from said lower end of said housing to a locus adjacent a shoulder of the drill bit, which shoulder defines the upper extremity of a gauge section of the drill bit, when the drill bit is connected to said lower end of said rotor.

19. A method of drilling a substantially vertical borehole in an earthen formation, comprising the steps of:

(a) actuating a drilling motor to rotate a rotor thereof within a housing thereof so that a drill bit connected to the rotor rotates at a first speed within the earthen formation and excavates material therefrom across a first diameter;

(b) applying weight to the drilling motor; and (c) simultaneously with said steps (a) and (b), reducing hang-up and bit whirl within the borehole, including rotating the housing, to which are connected stabilizing means for stabilizing the drill bit and cutting means for enlarging the borehole, and the stabilizing means and the cutting means at a second speed less than the first speed so that the cutting means excavates material from the borehole across a second diameter greater than the first diameter to reduce the drilling motor and the stabilizer means hanging up on the borehole and further so that the stabilizing means engages the enlarged borehole to reduce lateral movement of the drill bit within the borehole.

20. A method as defined in claim 19, wherein said step (c) further includes depending the stabilizing means and the cutting means from the housing so that lower ends of the stabilizing means and the cutting means are adjacent the drill bit.

* * * * *